United States Patent [19]

Thompson

[11] 4,416,420

[45] Nov. 22, 1983

[54] PORTABLE FOUNTAIN FOR POOLS OR SPAS

[76] Inventor: Stanley C. Thompson, 7851 Talbert St., Apt. 1, Playa del Ray, Calif. 90271

[21] Appl. No.: 353,370

[22] Filed: Mar. 1, 1982

[51] Int. Cl.[3] ..... B05B 17/08

[52] U.S. Cl. ..... 239/22

[58] Field of Search ..... 239/16–23, 239/211, 289

[56] References Cited

U.S. PATENT DOCUMENTS

| | | | |
|---|---|---|---|
| 1,962,840 | 6/1934 | Rives | 239/17 |
| 3,101,173 | 8/1963 | Jennings | 239/23 |
| 3,318,528 | 5/1967 | Williams | 239/17 |
| 3,506,196 | 4/1970 | Ramsey | 239/17 |
| 3,773,258 | 11/1973 | Hruby | 239/17 |
| 3,820,715 | 6/1974 | Hamilton | 239/17 |
| 4,088,880 | 5/1978 | Walsh | 239/18 X |
| 4,174,808 | 11/1979 | Latin | 239/23 |

*Primary Examiner*—Andres Kashnikow

*Attorney, Agent, or Firm*—William W. Haefliger

[57] ABSTRACT

A pool or spa portable fountain which comprises a pedestal, an upright tube supported by the pedestal, a duct which is supported by the pedestal to extend upwardly within the tube, a discharge head which is connected to the upper end of the duct and is capable of discharging water under pressure to form a fountain spray pattern, and a hose extending from a lower portion of the duct and via the interior of the pedestal to the exterior thereof, to receive a pressurized stream of water for delivery to the duct. The pedestal and tube are dimensioned so as to have the top portion of the tube project above the water surface level when the fountain is positioned on the bottom of the pool. The fountain can be easily and quickly removed or repositioned when necessary.

8 Claims, 3 Drawing Figures

FIG. 1.
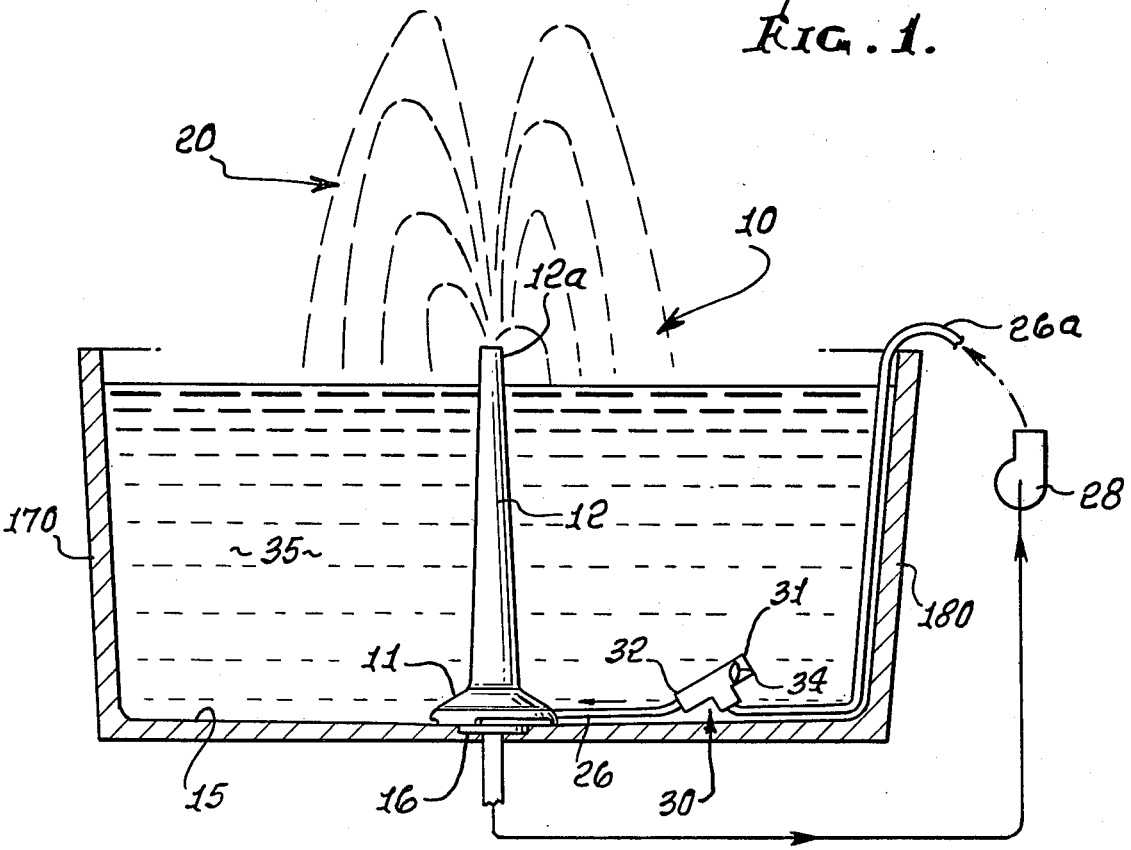
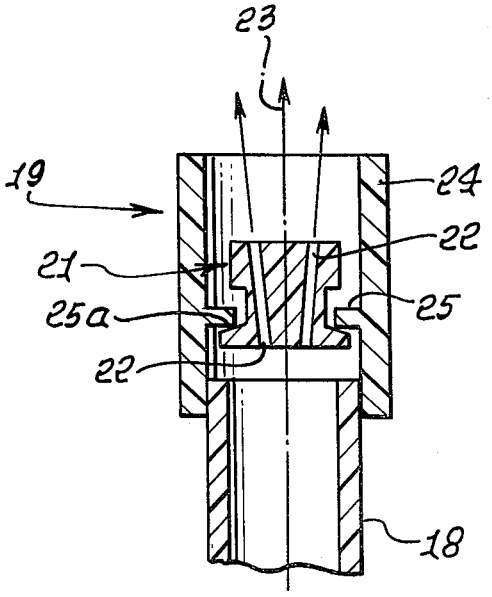
FIG. 3.

20
12a
19
21
14
12b
18
~35~
26a
30
12
31
11a
11
32
34
27
11c
26
~13~
11b
16
15
11d
11d

PORTABLE FOUNTAIN FOR POOLS OR SPAS

BACKGROUND OF THE INVENTION

This invention relates generally to fountains, and more particularly concerns portable fountains usable in pools and spas.

There is need for fountains which can be used in pools and spas, as for decorative effect; more specifically, there is need for fountains which can be easily placed and operated in pools and spas, and which can be easily and quickly removed or repositioned when necessary, so as to permit use of the water by bathers. Such fountains must also be of simple, low-cost construction.

SUMMARY OF THE INVENTION

It is a major object of the invention to provide a pool or spa fountain that will meet the above need. As will appear, the fountain basically comprises:

(a) a pedestal and an upright tube supported by the pedestal, the pedestal adapted to be adjustably positioned on the bottom of the pool or spa so that the top portion of the tube projects above water surface level, (b) a duct supported to extend upwardly within the tube, and a discharge head at the terminal of the duct to discharge water under pressure to form a fountain spray pattern, (c) and a hose extending from a lower portion of the duct and via the interior of the pedestal to the exterior thereof, to receive a pressurized stream of water for delivery to the duct.

Additional objects of the invention include the provision of a pedestal which is integral with the upright tube and which is bell-shaped so as to encompass and conceal a pool or spa drain; the provision for suspension of the duct within the tube and connection of the lower terminal of the duct to the hose within the fountain, the hose being transparent externally of the pedestal; and the provision for water supply adjustable flow division as between the fountain and the pool or spa water.

These and other objects and advantages of the invention, as well as the details of an illustrative embodiment, will be more fully understood from the following description and drawings, in which:

DRAWING DESCRIPTION

FIG. 1 is an elevation showing use of a fountain embodying the invention;

FIG. 3 is an enlarged vertical section taken through a spray head.

DETAILED DESCRIPTION

Figure 2:
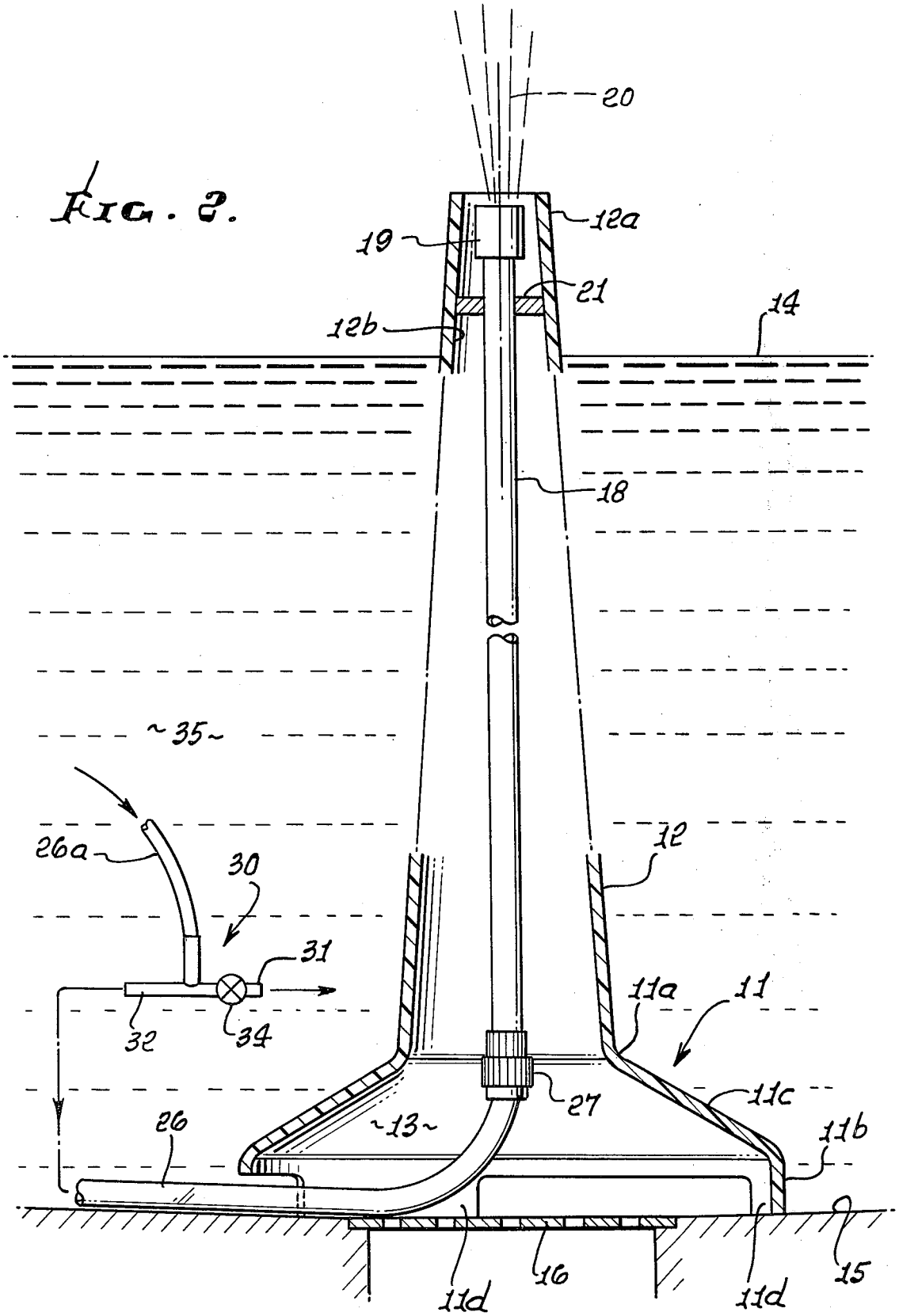
FIG. 2 is an enlarged elevation, in section, showing details of the FIG. 1 fountain.

In the drawings, the portable fountain 10 includes a pedestal 11 and an upright tube 12 supported by the pedestal. These elements may be integrally connected, as by molding them as a single unit of glass fibers and resin. The pedestal is in the form of a bell-shaped shell containing a central hollow 13, and it includes a concave neck 11*a* and a convex skirt 11*b*, these two merging at region 11*c*. The tube 12 is vertically elongated, and tapers upwardly as shown to terminate at 12*a* above pool or spa water surface level 14. The pedestal and tube have a vertical height between 3 and 10 feet, so that the pedestal may be seated on the pool or spa bottom surface 15, and directly over a drain 16, spanning and concealing the latter. Note the three legs 11*d* of the pedestal; the exterior surface of the pedestal and tube may be colored as by a selected color gel coating thereon; the pool or spa side walls appear at 170 and 180.

A duct 18, preferably comprising a PVC plastic pipe, is supported to extend upwardly within tube 12, and a discharge head 19 is located at the upper terminal of the duct to discharge water under pressure to form a spray pattern 20. To this end, a brass ring 21 may be pressed or wedged into position between the duct outer wall and the tube inner wall 12*b*. FIG. 3 shows the head 19 as including a tubular element 24 connected to the upper end of the tube 18 and supporting a spinner 21 to rotate in response to water passage under pressure through the ports 22 in the spinner. Such ports are suitably angled to extend upwardly and partly about central axis 23 to exert torque on the spinner for rotating same and producing a spiraling spray pattern 20. Merely as illustrative, the element 24 has a bearing in the form of an annular ledge 25 on which the spinner rotates, as by engagement at 25*a*.

A hose 26, preferably transparent, extends from a lower portion of the duct and via the interior 13 of the pedestal to receive a pressurized stream of water for delivery to the duct. In the example, the hose has connection via adapter 27 to the lower terminal of the tube, and the hose passes downwardly and sidewardly from the adapter, and through the side of the pedestal. A pump 28 is shown in FIG. 1 as supplying water under pressure to the hose extension 26*a* which extends downwardly into the pool or spa. A flow divider 30 is connected with hose extension 26*a* to receive pressurized water, and it has a first discharge, as via tee leg 31, to the pool, and a second discharge via tee leg 32, to hose 26. Accordingly, part of the water supply flows to the fountain and the remainder flows directly to the pool or spa water body 35. A control valve 34 in the tee leg 31 is adjustable to decrease or increase the flow to the pool, thereby increasing or decreasing the flow to the fountain. The divider may be located at the bottom of the pool, for concealment.

I claim:

1. In a pool or spa portable fountain and in combination with the pool or spa, the combination comprising (a) a pedestal and an upright tube supported by the pedestal, the pedestal adapted to be adjustably positioned on the bottom of the pool or spa so that the top portion of the tube projects above water surface level, (b) a duct supported to extend upwardly within the tube, and a discharge head at the terminal of the duct to discharge water under pressure to form a fountain spray pattern, (c) and a hose extending from a lower portion of the duct and via the interior of the pedestal to the exterior thereof, to receive a pressurized stream of water for delivery to the duct, (d) the duct being relatively rigid and vertically elongated within the tube, and the hose being flexible and having connection with the lower terminal of the duct, (e) the pedestal having generally bell shaped, hollow configuration, and the tube tapering upwardly from the pedestal, the pedestal and tube having one-piece, integral molded plastic construction, the bell shaped pedestal forming multiple support legs, the hose projecting between leg extents, (f) and a flow divider including a tee connected with said hose, the divider having a discharge to the pool or spa, whereby part of the water supplied to the divider flows to the pool, and the remainder of the water supplied to the divider flows to the fountain via said hose, said divider including an adjustable control valve connected with said tee to adjust the flow of water to the pool to thereby increase or decrease the flow to the fountain, (g) the pedestal located over a drain in said bottom of the pool or spa, the pedestal opening downwardly.

2. The combination of claim 1 wherein, said tube projects upwardly so that the top portion of the tube emerges from and projects above the water surface.

3. The combination of claim 2 wherein the overall upright length of the pedestal and tube is between 3 and 10 feet.

4. The combination of claim 1 including means suspending said duct in said tube.

5. The combination of claim 1 including a color coating on the surface of the tube and pedestal.

6. The combination of claim 1 wherein said hose is substantially transparent.

7. The combination of claim 1 including a brass ring pressed between the duct outer wall and the inner wall of the tube to suspend the duct in the tube.

8. The combination of claim 7 including a rotating spray head on the upper end of the tube.

* * * * *